US005379808A

United States Patent [19]

Chiu

[11] Patent Number: 5,379,808

[45] Date of Patent: Jan. 10, 1995

[54] MULTI-PLY PAPERMAKING FABRIC WITH OVATE BINDER YARNS

[75] Inventor: Kai F. Chiu, Brandon, Miss.

[73] Assignee: Lindsay Wire, Inc., Florence, Miss.

[21] Appl. No.: 117,005

[22] PCT Filed: Feb. 8, 1993

[86] PCT No.: PCT/US93/01096

§ 371 Date: Sep. 8, 1993

§ 102(e) Date: Sep. 8, 1993

[87] PCT Pub. No.: WO93/16221

PCT Pub. Date: Aug. 19, 1993

[51] Int. Cl.[6] ..... D03D 13/00

[52] U.S. Cl. ..... 139/383 A; 162/903

[58] Field of Search ..... 139/383 A; 162/903

[56] References Cited

U.S. PATENT DOCUMENTS 4,314,589 2/1982 Buchanan et al. .
4,501,303 2/1985 Osterberg .
4,705,601 11/1987 Chiu .
4,729,412 3/1988 Bugge .
4,832,090 5/1989 Krenkel et al. .
4,945,952 8/1990 Vohringer .
4,967,805 11/1990 Chiu et al. .
5,054,525 10/1991 Vohringer .
5,114,777 5/1992 Gaisser ..... 139/383 A
5,151,316 9/1992 Durkin et al. ..... 139/383 A
5,152,326 10/1992 Vohringer ..... 139/383 A
5,219,004 6/1993 Chiu ..... 139/383 A

*Primary Examiner*—Andrew M. Falik
*Attorney, Agent, or Firm*—Dann, Dorfman, Herrell and Skillman

[57] ABSTRACT

A multi-ply forming fabric for use at the wet end of a papermaking machine for receiving wet pup having a substantial portion of recycled paper fibers. The forming fabric cannot be characterized as either a conventional double-layer or triple-layer fabric. The fabric has an independent top ply comprising a self-sustaining weave of warp yarns and shute yarns, and a bottom side comprising a series of dependent shute yarns interwoven with the top ply by binder warp yarns. The binder warp yarns are illustrated as single and double round yarns, and single ovate yarns. The fabric has a reduced caliper, larger internal fiber interstices and substantial projected open areas which trap fewer contaminants and allow the fabric to be more easily cleaned.

11 Claims, 4 Drawing Sheets

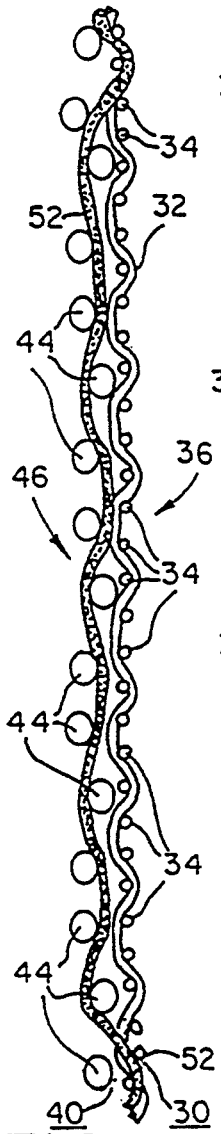
FIG. 3
FIG. 2
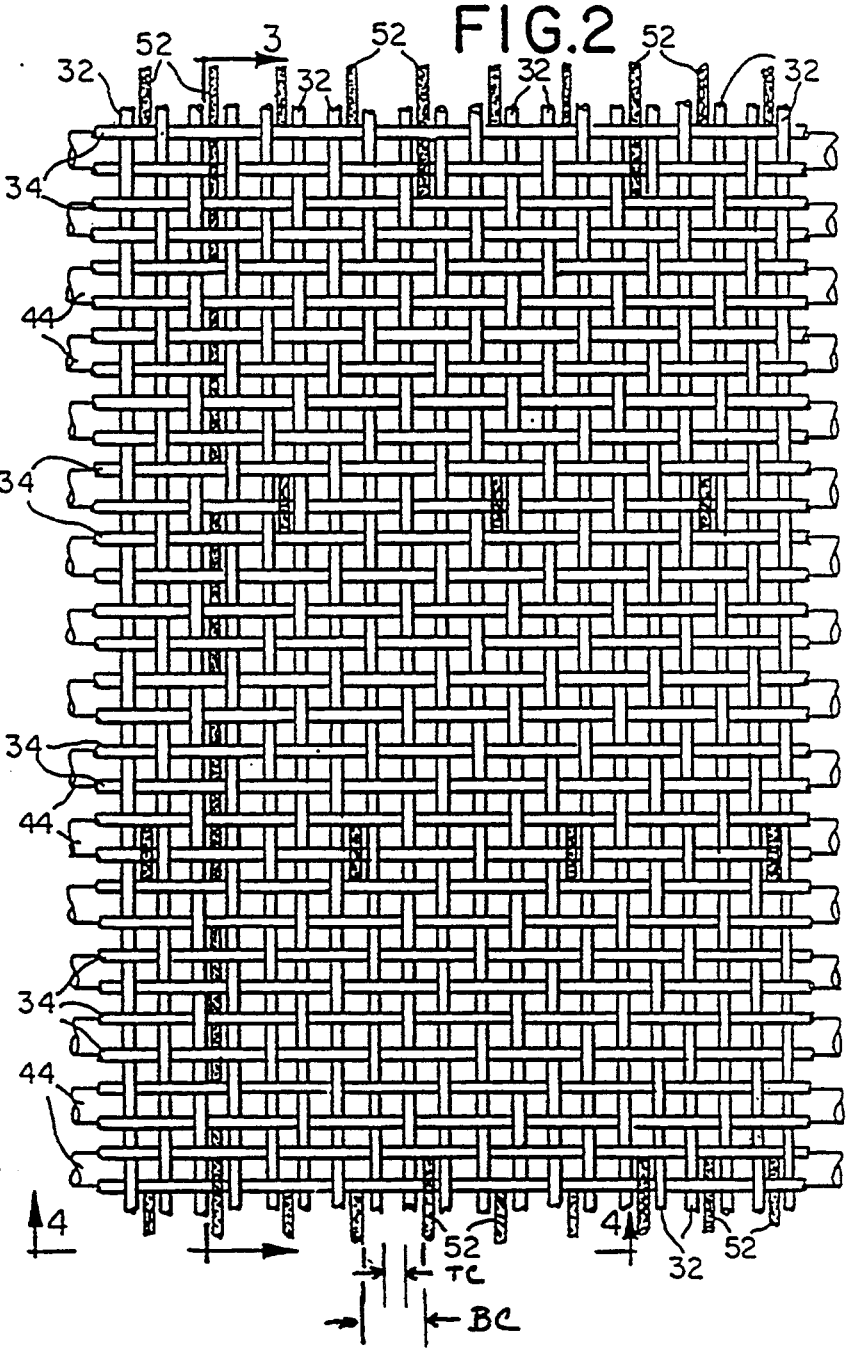
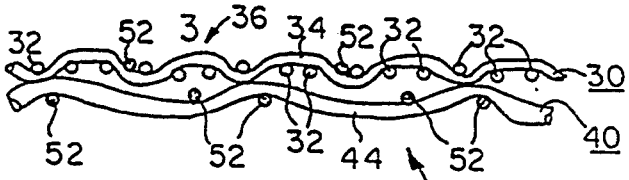
FIG. 4

MULTI-PLY PAPERMAKING FABRIC WITH OVATE BINDER YARNS

FIELD OF THE INVENTION

The present invention relates to an improved multi-layer, paper-forming fabric or wire for use in a paper-making machine. The fabric of the present invention is particularly useful for supporting the paper web at the wet end of the paper-making machine in a process which uses a substantial portion of recycled paper pulp.

BACKGROUND OF THE INVENTION

Polymer forming fabrics are becoming increasingly more complex to suit the changing demands of the paper-making industry. One major development in the paper-making industry, which has necessitated improvement in the structure of existing forming fabrics, is the increased use of recycled paper fibers. As more and more recycled pulp fibers are introduced into the pulp slurry, the shorter recycled fibers along with the associated pulp contaminants have a deleterious effect on the drainage, cleaning, and wear characteristics of the forming fabric.

While having a fine mesh on the top surface, the forming fabric must maintain a high degree of porosity to afford extraction of large quantities of water from the pulp. Forming fabrics with complex weaves have very small filament interstices which easily become blocked with contaminants during the useful life of the fabric. The contaminants which become embedded in the fabric also promote localized wear on the internal fabric binder.

For example, conventional "triple-layer" fabrics typically have a separate system of mono-filament binding yarns interweaving with and connecting the independent top and bottom plies. The top and bottom plies of the fabric have different moduli of elasticity. As the fabric is trained around the guide rollers at the forming end of the paper-making machine, flexing of the two plies generates stresses and strains which permit a degree of relative longitudinal displacement between the top and bottom plies. The relative displacement causes internal localized wear on the binder and prematurely wears or "saws" the binder before the useful wear life of the fabric's bottom ply is fully utilized. Internal binder wear is greatest at the contact point between the larger bottom warp and the binder. As a result, fabric irregularities and delamination of the two independent top and bottom layers develop which adversely affect the paper web formed on the fabric.

Due to the complexity of their weaves and the presence of the large bottom warp, conventional "triple-layer" fabrics have a high caliper with a large amount of void space within the structure. The fabric retains a significant amount of water in the voids after the belt has travelled past the dewatering elements to the exit end of the forming section of the machine. The drier pulp at the exit end of the forming section then has a tendency to reabsorb the water entrained in the body of the fabric. High caliper also adversely affects the flexibility of the fabric in the machine direction. Flexibility in the machine direction permits "table activities", i.e. agitating the pulp as the belt travels on the forming table to facilitate dispersion of the wood fibers more uniformly throughout the layer of pulp on the fabric, thereby enhancing the uniformity in paper formation on the machine.

SUMMARY OF THE INVENTION

The forming fabric of the present invention provides a multi-ply forming fabric which cannot be characterized as either a "double-layer" or "triple-layer" fabric. More specifically, like a "triple-layer" forming fabric, the present invention provides a multi-ply forming fabric having a self-sustaining, independent top ply comprising a system of top warp yarns interwoven with a system of top shute yarns. The top ply has a top pulp face which provides a preselected surface characteristic in the paper web formed on the pulp face.

Unlike the "triple-layer", the bottom side of the present invention has no self-sustaining, independent bottom ply. Instead, it has a bottom machine face comprising a system of bottom shute yarns larger than the top shute yarns. The top ply has twice as many shute yarns as the bottom side. The bottom side has no independent warp system but rather is interwoven with and connected to the top ply by a warp binder system comprising single or grouped binder arrangements. The diameter of the warp binder can be of the same, bigger or smaller diameter as the top warp yarns. In contrast, the binder in a "triple-layer" is always the smallest diameter of all the yarn components of the fabric. Additionally, the fabric of the present invention has no shute binder yarns.

Like the "double-layer" weave, all the warp directional yarns can be of the same diameter. However, while the "double-layer" warps are arranged side by side resulting in no projected open area as viewed from the top, the present invention has warps arranged in groups with definite projected open area between warp groups for ease of cleaning.

The fabric has particular application in a papermaking machine which uses a substantial portion of recycled paper pulp. The absence of an independent bottom warp system and shute binder system results in larger internal interstices which reduce the number of contaminants which are trapped in the body of the fabric and enhances cleaning by continuous showers. The absence of a large bottom warp system also significantly reduces the caliper of the fabric which reduces the volume of water capable of being entrained in the body of the fabric and reduces rewetting. The fabric's reduced caliper also enhances the flexibility of the fabric which facilitates more uniform dispersion of the paper fibers on the fabric.

Since the fabric of the present invention does not have two self-sustaining weaves in a top and bottom ply with two different moduli of elasticity, internal stress and strain which cause localized wear on the binder is reduced. The warp binder is interwoven in a manner such that exposure of the binder on either the top pulp face or bottom machine face is minimized. The fabric can be woven more quickly than conventional "triple-layer" fabrics since the forming fabric has no independent bottom warp system or shute binder system.

BRIEF DESCRIPTION OF THE DRAWINGS

All of the objects of the invention are more fully set forth hereinafter with reference to the accompanying drawings wherein:

FIG. 2 is an enlarged fragmentary top plan view of one embodiment of the fabric of the present invention having a single warp binder;

FIG. 3 is a shute-wise cross-sectional view taken along line 3—3 of FIG. 2;

FIG. 4 is a warp-wise cross-sectional view taken along line 4—4 of FIG. 2;

FIG. 5 is an enlarged fragmentary top plan view of another embodiment of the fabric of the present invention having a double warp binder;

DETAILED DESCRIPTION OF A PREFERRED EMBODIMENT

Figure 1:
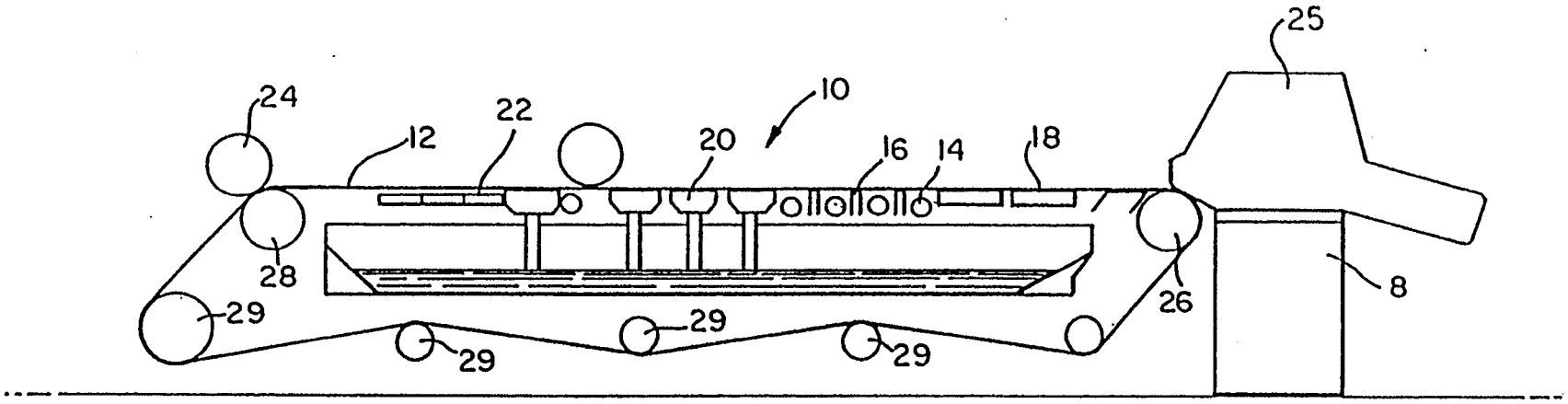
FIG. 1 is a diagrammatic view of the forming section of a paper-making machine embodying a forming fabric made in accordance with the present invention.
Figure 11:
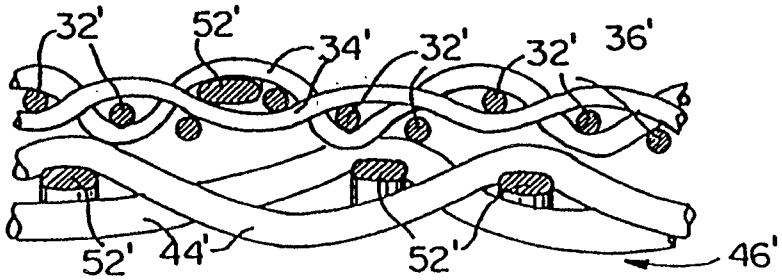
FIG. 11 is an enlarged fragmentary warpwise sectional view illustrating the character of the yarns.

Referring to FIG. 1, one embodiment of the fabric of the present invention is shown diagrammatically on a typical paper-making machine in the forming section. A forming section, also referred to as the Fourdrinier wire section, indicated generally by reference number 10 includes a forming fabric 12. The forming section 10 is so called because the paper-forming fibers in the pulp slurry are deposited on top of an endless forming fabric belt 12 running horizontally over processing elements positioned under the horizontal upper run of the fabric belt. The processing elements are supported by side beams 8 and include: plain or grooved table rolls 14; single or double deflectors 16; foils 18; wet suction boxes 20; dry suction boxes 22; and lump breaker rolls 24. The belt has a width corresponding to the width of a paper-making machine and a length in the form of a continuous loop corresponding to the length of the path of travel of the fabric through the machine. The belt is contained, supported and driven by a number of rolls including: breast roll 26 underneath a headbox 25 from which the pulp slurry is deposited on the belt; couch roll 28; and return rolls 29.

Referring to FIGS. 2–4 the fabric of one embodiment of the present invention comprises an independent, top ply indicated generally by reference number 30 for receiving wet pulp on a top pulp face and forming the pulp into a consolidated web. The top ply has a self-sustaining weave construction comprising top warp yarns 32, preferably tensioned so as to provide a uniform top pulp face denoted generally by reference number 36 when woven with shute yarns 34. The top ply is normally an independent single-layer weave in plain 1×1, basket 2×2, straight 1×2, 1×3, 1×4, or 2×3 in straight twill, or satin weave pattern. More complicated single weave patterns may also be used. The top warps 32 are preferably round but may be either round or flat or rectangular or ovate in shape as taught, for example, by Chiu U.S. Pat. No. 4,705,601, incorporated herein by reference.

The fabric has a dependent lower side denoted generally by reference number 40 for affording discharge of the free water content of the wet pulp. The bottom side comprises shute yarns 44 for resisting wear on the bottom machine face denoted generally by the reference number 46. In contrast to the upper ply 30, the bottom side 40 has no independent bottom warp yarns interwoven with the bottom shute yarns 44 to form a self-sustaining weave construction. Rather, the shute yarns 44 in the bottom side are dependent upon binder warp yarns 52, discussed hereinafter, for binding to the top ply. Preferably there are approximately twice as many shutes in the top ply as in the bottom side. It is also preferred that the bottom shutes 44 have a larger diameter than the top shutes 34 for greater wear resistance since the bottom shutes 44 contact the abrasive dewatering elements and belt rollers of the paper-making machine.

In one embodiment of the present invention, the fabric comprises single binder yarns 52 which serve the function of interweaving and interconnecting the bottom shute yarns 44 with the top ply 30. The single warp binder yarns 52 follow the path shown in FIGS. 2–4. The warp binders 52 attach to the top ply adjacent to the knuckles where the top warps 32 overlay the top shutes 34. By sharing the same binding position disturbance to the topography of the top pulp face and exposure of the warp binder on the top pulp face 36 is minimized as seen in FIGS. 3 and 4. The binder 52 passes under at least one bottom shute 44 in the bottom side 40, preferably in a manner such that the binder 52 is buried in the body of the fabric and does not have any substantial exposure on the bottom machine face 46 of the fabric as seen in FIGS. 3 and 4. Like the top ward yarns 32, the binder warps 52 are preferably round but any or all of the yarns may be ovate, flat or rectangular. The binder warps 52 may have different but preferably the same diameter as the top warps 32.

The distribution and frequency of the binding points can be arranged to give both uniform appearance and mechanical stability to the fabric structure, as shown, for example, in FIG. 2 which illustrates the weave pattern of this embodiment of the fabric. The top ply preferably Has a warp density typical of a conventional single layer in the range of approximately 50% to 60% warp coverage. The top surface can be woven with the long shute knuckles on the face side as shown or it can be woven with the long warp knuckles on the face side to achieve a different surface texture.

Figure 8:
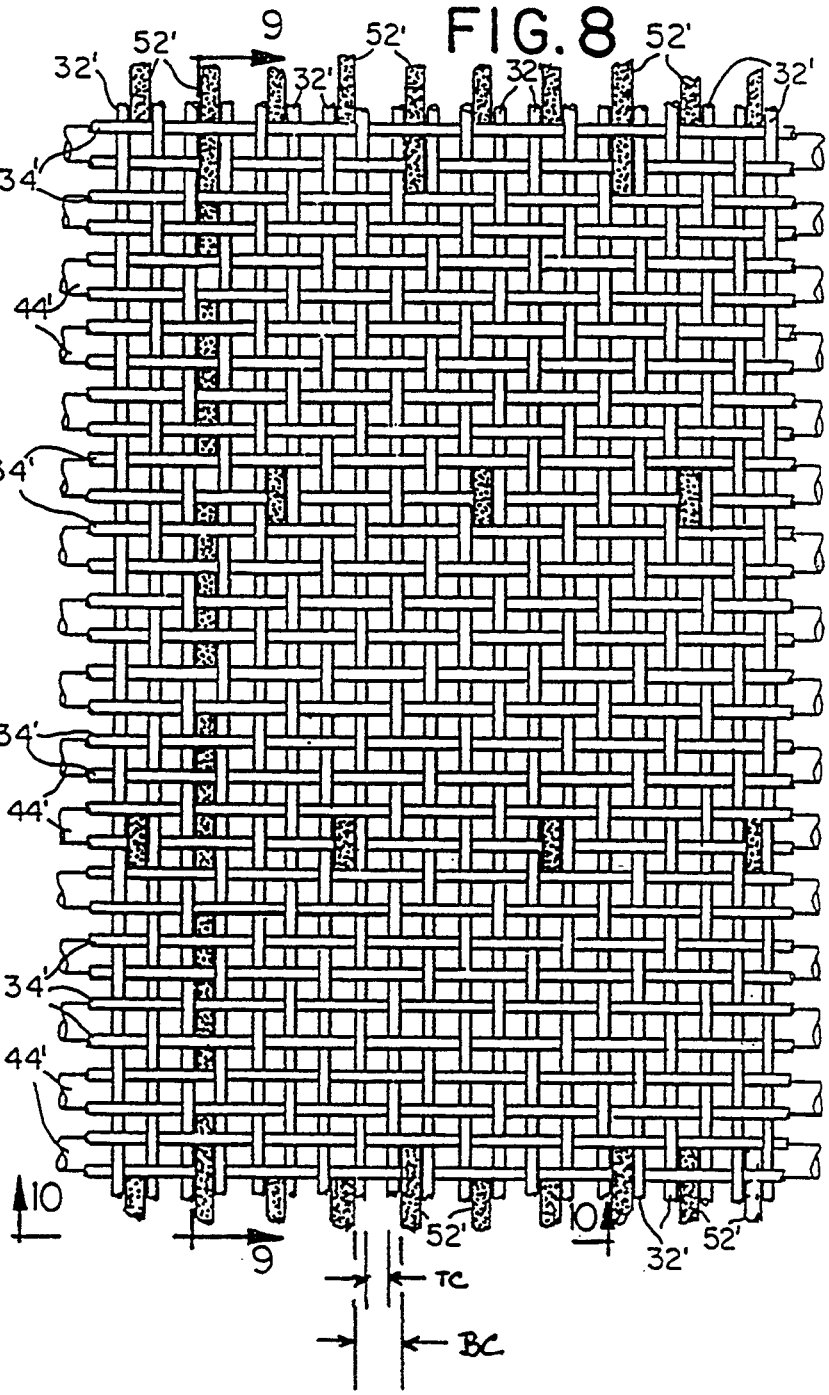
FIG. 8 is an enlarged fragmentary top plan view of a third embodiment of the fabric of the present invention having an ovate warp binder.
Figure 10:
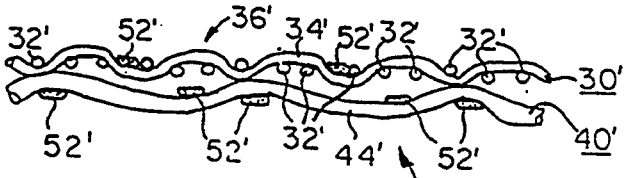
FIG. 10 is a warp-wise cross-sectional view taken on the line 10—10 of FIG. 8.

As shown, the top warp yarns 32 have a substantially uniform spacing across the width of the fabric and have a warp density to provide channels TC between the yarns affording the discharge of the free water through the top layer. Likewise, the individual binder warps 52, 52′ (FIG. 8) or the paired binder warps 152 and 154 (FIG. 5) are spaced apart across the width of the fabric to produce channels TC between the yarns, either individual or paired, as viewed from the top plan. At least half of the TC channels formed by the top warp yarn in the top ply are in vertical registry with the BC channels formed by the binder warps to provide a direct and free liquid passage through the interstices in the upper ply and the lower layer. The binder warp density is preferably not greater than that of the top ply to insure that the binder warps provide enough open BC channels which may be in registry with the TC channels of the upper ply. The open channels produce substantial projected open areas when viewed in plan.

It should be appreciated that the fabric of the present invention is particularly useful in papermaking processes using a substantial portion of recycled paper pulp since the present fabric has half as many bottom shutes 44 and has no bottom warps and, thus, larger internal interstices in the fabric structure than in conventional double-layer or triplelayer fabrics. As more and more recycled paper pulp is added to the pulp slurry, a greater number of contaminants mix with the paper fibers and become embedded in the fabric which can accelerate both internal binder wear and bottom shute wear. Larger internal interstices trap fewer contaminants and allow the fabric to be more easily cleaned by continuous cleaning showers. The channels and the substantial projected open areas afford direct penetration of water for the cleaning showers into and through the internal structure of the fabric. Conventional double-layer and triple-layer fabrics have many more yarn crossings in the internal structure which trap contaminants and block drainage.

Unlike conventional triple-layer fabrics, the fabric of the present invention is not prone to delamination of the top and bottom layers due to binder failure since the fabric is more flexible and not formed of two independent, self-sustaining plies with different moduli of elasticity. Since the bottom shutes are not bound in an independent layer, the bottom shutes have freedom to move relative to each other to account for the differential in circumference of the top ply and bottom shutes as the belt is trained around the various rollers of the paper-making machine. In this manner, the bottom shutes move together with the top layer weave structure, thereby eliminating any relative longitudinal displacement or internal stresses between the upper ply and the bottom shutes.

The absence of an independent system of bottom warps in the fabric of the present invention greatly enhances the porosity of the bottom side of the fabric without creating substantial voids in the top pulp face 36. Greater porosity in the bottom side enhances water extraction from the pulp without adversely affecting the surface density of the paper web formed on the fabric. It should also be appreciated that the absence of a system of bottom warps reduces the caliper of the bottom side and thus the total caliper of the fabric. Conventional triple-layer fabrics have a tendency to carry along a substantial amount of water which was extracted from the pulp but is retained in the body of the fabric itself. Using such a conventional fabric, the dried paper web has a tendency to absorb the water entrained in the body of the fabric. The present fabric has a reduced caliper and less internal fabric volume to entrain water after the fabric has travelled past the dewatering elements to the exit end of the forming section.

The fabric of the present invention is also easier and faster to weave since it utilizes no binder shutes. In prior conventional fabrics, the binder shute's only function is to bind the top ply and bottom side and the binder shutes generally serve no function in forming the paper pulp on the fabric. The weave of the present fabric makes efficient use of every shute. The top shute yarns form the paper web while the bottom shute yarns enhance wear resistance. Additionally, since the top warp and the warp binder can be made of the same or different diameters, either single or double warp beam weaving looms can be used to produce the fabric.

While the fabric is preferably woven flat and then seamed with the warp directional strands bearing the running tension of the paper machine, this fabric can also be woven as a continuous loop with more manufacturing difficulties. It is well known that in general, increasing the crimp in the warp knuckles increases the strength of the seam. The use of warp binders instead of shute binders provides a stronger seam for the fabric as compared to conventional triple-layer structures because the warp binder passes over both the top and bottom faces resulting in a maximum crimped knuckle configuration which strengthens the seam's tensile strength.

As compared to conventional double-layer or triple-layer fabrics, a larger diameter shute can be used in the bottom side for greater wear resistance. Since this fabric has a reduced caliper and has fewer filaments in the bottom side, the drainage and cleaning characteristics are not adversely affected by the larger diameter bottom shute yarns 44 which protrude from the bottom wear face as seen in FIGS. 3 and 4.

Figure 6:
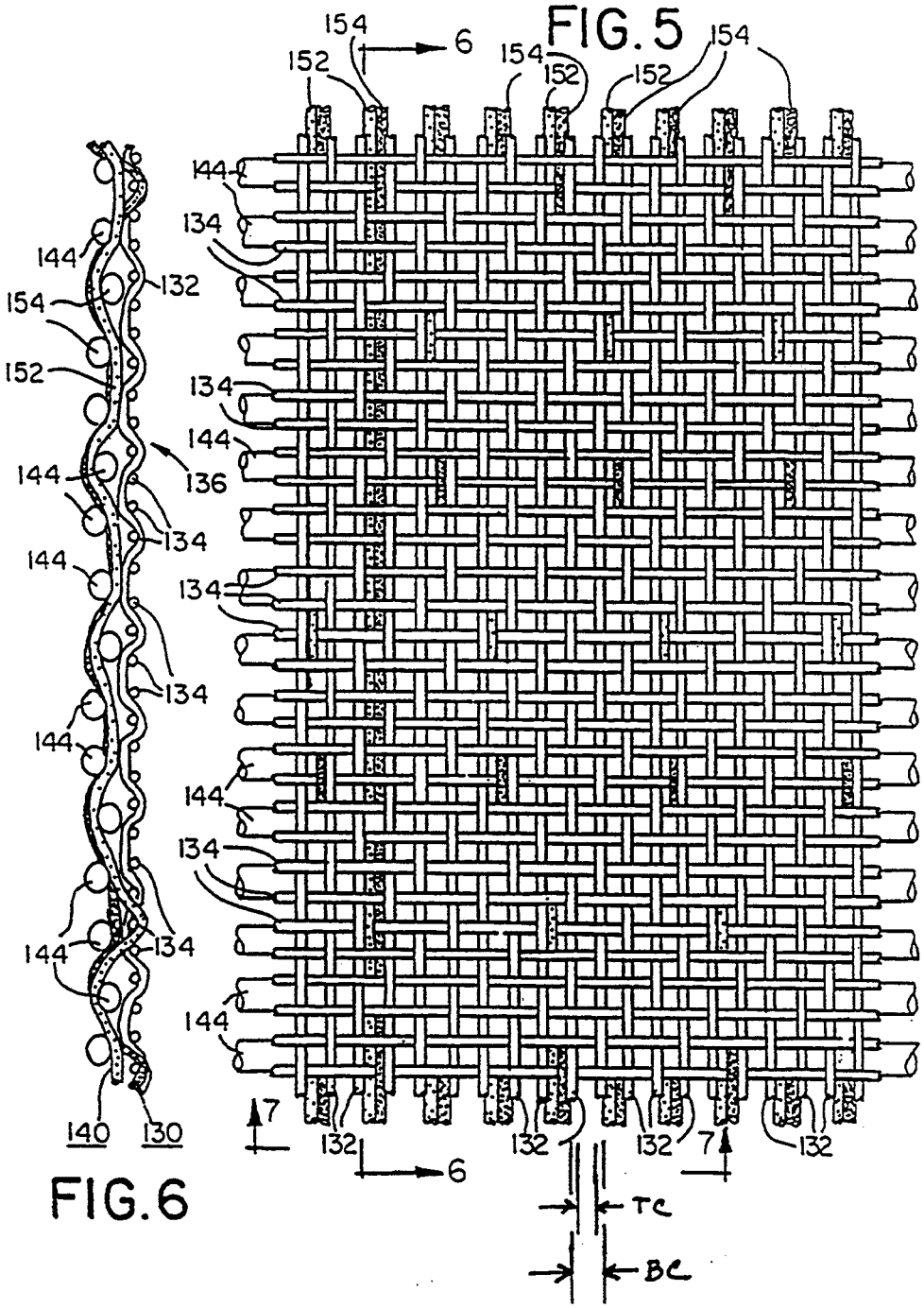
FIG. 6 is a shute-wise cross-sectional view taken along line 6—6 of FIG. 5.
Figure 7:
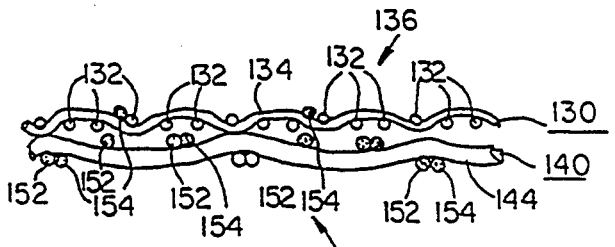
FIG. 7 is a warp-wise cross-sectional view taken along line 7—7 of FIG. 5.
Figure 9:
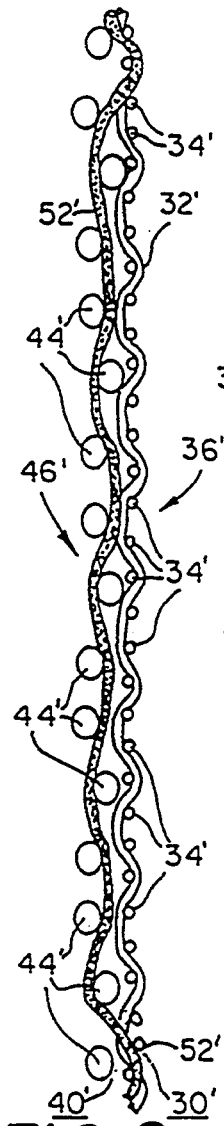
FIG. 9 is a shute-wise cross-sectional view taken on the line 9—9 of FIG. 8.

Another embodiment of a fabric according to the present invention is shown in FIGS. 5–7. This fabric is similar to the first embodiment except for the warp binder yarns. In these figures, the corresponding components have been identified with the same reference numerals, but with a prefix of "1". In this embodiment the warp binder comprises a pair of warp yarns 152 and 154 interwoven with the top ply 130 and bottom side 140. As seen in FIGS. 5–7, the warp binders 152 and 154 in the warp binder pair have alternate binding patterns such that only one binder yarn of the pair passes above a top shute 134 at a time.

A third embodiment of a fabric according to the present invention is shown in FIGS. 8–11. This fabric is similar to the first two embodiments except for the warp binder yarns. In these figures, the corresponding components have been identified with the same reference numerals as in FIGS. 2–4, but followed by a prime (′). In this embodiment, the warp binder 52′ comprises an ovate yarn having a horizontal thickness approximately twice the vertical thickness of the yarn. In both the second and third embodiments of the fabric, the extra horizontal thickness provided by the binder warp pairs 152 in FIGS. 5–7 and the ovate binder warps 52′ in FIGS. 8–11 maintain the top warp yarns spaced apart providing an open TC channel in the upper ply in those areas of the fabric where the binder yarn is interwoven with the enlarged shute yarns in the lower layer below the top ply, thereby enhancing the drainage which is designed to accommodate the contaminated liquid discharged from the recycled pulp. In FIGS. 8–11 the ovate yarns have a horizontal dimension corresponding in width with the TC channels. The use of the paired binder warps in FIGS. 5–7 and the ovate binder warps in FIGS. 8–11 enable the binder warps to maintain the separation of the warps in the top fabric ply without causing the binder warps to project upwardly beyond the upper surface of the top ply.

In all of the embodiments of the invention, the binder warp yarn interweaves with the bottom shutes to anchor the bottom shutes against the undersurface of the top ply, the binder warp intermittently extending into the top ply and over a single top shute in the channels between the top warp yarns to provide knuckles which are widely-spaced warp-wise in the top ply, the knuckles in adjacent binder warps on opposite sides of each binder warp being staggered warp-wise of the fabric.

While particular embodiments of the present invention have been herein illustrated and described in reference to the paper-making machine illustrated in FIG. 1, it is not intended to limit the invention to such disclosures. Other forming machines may include suction breast roll formers, cylinder machines, twin wire formers, top wire formers and variations thereof, changes and modifications may be made therein and thereto for use in any paper-making wet process such as pulping, forming, pressing or drying in which an endless belt or flat fabric comprising a major proportion by weight of synthetic filament is used for receiving a pulp slurry, all within the scope of the following claims.

I claim:

1. A forming fabric for use at the wet end of a paper making machine for receiving wet pulp, said fabric comprising a multi-ply fabric having a width corresponding to the width of the paper-making machine and a length in the form of a continuous loop corresponding to the length of the path of travel of the fabric through the paper machine, and having a top pulp face and a bottom machine face, said top pulp face forming the pulp into a consolidated web by affording discharge of the free water content of the wet pulp from the bottom machine face, said fabric comprising:

a top ply having a self-sustaining weave construction comprising top warp yarns interwoven with top shute yarns in a weave pattern on the top face selected to produce a desired surface texture in the paper produced from the web formed on said top pulp face, said top warp yarns having substantially uniform spacing across the width of the fabric and having a warp density to provide channels between the yarns affording said discharge of free water;

a bottom side consisting essentially of a series of bottom shute yarns; and ovate binder warp yarns interweaving the top ply and the bottom shute yarns to form a self-sustaining fabric construction which is characterized by a high degree of porosity, said ovate binder warps having a warp density not greater than the warp density of the top ply, and being so arranged that the binder warps cannot block all of the channels provided in the top ply, said top warp yarns and said ovate binder warp yarns constituting the only two warp systems in the fabric, said ovate binder warp yarns providing the only components interweaving the bottom shute yarns with one another and with the yarns in the upper ply.

2. A forming fabric according to claim 1 wherein said top ply has an independent single-layer weave construction.

3. A forming fabric according to claim 1 wherein the ovate binder warp yarns in said series lie principally below the top ply and are passed over top shute yarns to form knuckles at intervals which are widely-spaced in the warp direction, the knuckles in adjacent binder warp yarns being staggered.

4. A forming fabric according to claim 1 having approximately twice as many top shute yarns as bottom shute yarns.

5. A forming fabric according to claim 1 wherein said top warp yarns and said ovate binder warp yarns are approximately equal in vertical thickness.

6. A forming fabric according to claim 1 wherein said bottom shute yarn is greater in horizontal thickness than said top shute yarn to afford greater wear resistance in said bottom layer than in said top ply.

7. A forming fabric for use at the wet end of a paper making machine for receiving wet pulp, said fabric comprising a multi-ply fabric having a width corresponding to the width of the paper-making machine and a length in the form of a continuous loop corresponding to the length of the path of travel of the fabric through the paper machine, and having a top pulp face and a bottom machine face, said top pulp face forming the pulp into a consolidated web by affording discharge of the free water content of the wet pulp from the bottom machine face, said fabric comprising:

a top ply having a self-sustaining weave construction comprising top warp yarns interwoven with top shute yarns in a weave pattern on the top face selected to produce a desired surface texture in the paper produced from the web formed on said top pulp face, said top warp yarns having substantially uniform spacing across the width of the fabric and having a warp density to provide channels between the yarns affording said discharge of free water;

a bottom side consisting essentially of a series of bottom shute yarns; and ovate binder ward yarns interweaving the top ply and the bottom shute yarns to form a self-sustaining fabric construction which is characterized by a high degree of porosity, said ovate binder warps having a warp density not greater than the warp density of the top ply, and being so arranged that the binder wards cannot block all of the channels provided in the top ply, said top warp yarns and said ovate binder warp yarns constituting the only two warp systems in the fabric, said ovate binder warp yarns providing the only components interweaving the bottom shute yarns with one another and with the yarns in the upper ply, each of said ovate binder warps having an upper knuckle which passes over one top shute yarn and a lower knuckle which passes under one bottom shute yarn in a manner such that said binder warp yarn does not have substantial exposure on either the top pulp face or bottom machine face.

8. A forming fabric according to claim 7 wherein said ovate binder warp yarn is interwoven with said top ply adjacent to a top warp yarn at a point where said top warp yarn passes over a top shute yarn.

9. A forming fabric for use at the wet end of a paper making machine for receiving wet pulp, said fabric comprising a multi-ply fabric having a width corresponding to the width of the paper-making machine and a length in the form of a continuous loop corresponding to the length of the path of travel of the fabric through the paper machine, and having a top pulp face and a bottom machine face, said top pulp face forming the pulp into a consolidated web by affording discharge of the free water content of the wet pulp from the bottom machine face, said fabric comprising:

a top ply having a self-sustaining weave construction comprising top warp yarns interwoven with top shute yarns in a weave pattern on the top face selected to produce a desired surface texture in the paper produced from the web formed On said top pulp face, said top warp yarns having substantially uniform spacing across the width of the fabric and having a warp density to provide channels between the yarns affording said discharge of free water;

a bottom side consisting essentially of a series of bottom shute yarns; and ovate binder warp yarns interweaving the top ply and the bottom shute yarns to form a self-sustaining fabric construction which is characterized by a high degree of porosity, said ovate binder wards having a warp density not greater than the ward density of the top ply, and being so arranged that the binder warps cannot block all of the channels provided in the top ply, said top warp yarns and said ovate binder warp yarns constituting the only two warp systems in the fabric, said ovate binder warp yarns providing the only components interweaving the bottom shute yarns with one another and with the yarns in the upper ply, said ovate binder warp yarns being spaced apart across the width of the fabric to produce lower channels between the binder warp yarns, at least half of the channels formed by said top warp yarns being in vertical registry with channels formed by said binder warp yarns to afford the discharge of free water through said registering channels, and direct penetration of liquid from cleaning showers.

10. A forming fabric for use at the wet end of a paper making machine for receiving wet pulp, said fabric comprising a multi-ply fabric having a width corresponding to the width of the paper-making machine and a length in the form of a continuous loop corresponding to the length of the path of travel of the fabric through the paper machine, and having a top pulp face and a bottom machine face, said top pulp face forming the pulp into a consolidated web by affording discharge of the free water content of the wet pulp from the bottom machine face, said fabric comprising:

a top ply having a self-sustaining weave construction comprising top warp yarns having a given vertical thickness interwoven with top shute yarns in a weave pattern on the top face selected to produce a desired surface texture in the paper produced from the web formed on said top pulp face, said top warp yarns having substantially uniform spacing across the width of the fabric and having a warp density to provide channels between the top warp yarns, said channels having a width equal to approximately twice said given vertical thickness affording said discharge of free water;

a bottom layer consisting essentially of a series of bottom shute yarns; and ovate binder warp yarns interweaving the top ply and the bottom shute yarns to form a self-sustaining fabric construction which is characterized by a high degree of porosity, said ovate binder warps having a vertical thickness equal to said given thickness, and a warp density not greater than the warp density of the top ply, and being so arranged that the ovate binder warps in selected channels provided in the top ply have a horizontal dimension corresponding substantially in width with said channel, but do not register with or block the non-selected channels of the top ply, said top warp yarns and said ovate binder warp yarns constituting the only two warp systems in the fabric, said ovate binder warp yarns providing the only components interweaving the bottom shute yarns with one another and with the yarns in the upper ply.

11. A forming fabric according to claim 10 wherein said selected channels alternate with said non-selected channels across the width of the fabric.

* * * * *

UNITED STATES PATENT AND TRADEMARK OFFICE

CERTIFICATE OF CORRECTION

PATENT NO. :5,379,808
DATED :January 10, 1995
INVENTOR(S) :Kai F. Chiu

It is certified that error appears in the above-indentified patent and that said Letters Patent is hereby corrected as shown below:

Column 4, line 31, change "ward" to --warp--;

Column 7, line 3, change "thereof, changes" to --thereof. Changes--;

Column 8, line 26, change "wards" to --warps--;

Column 9, line 1, change "wards" to --warps--;

Column 9, line 2, change "ward" to --warp--.

Signed and Sealed this

Seventh Day of March, 1995

Bruce Lehman

*Attest:*

BRUCE LEHMAN

*Attesting Officer*

*Commissioner of Patents and Trademarks*